United States Patent [19]

Karr

[11] 4,360,204

[45] Nov. 23, 1982

[54] GOLF BALL STORAGE AND FEEDER DEVICE

[76] Inventor: Robert J. Karr, 1605 - 16th St., Wyandotte, Mich. 48192

[21] Appl. No.: 910,297

[22] Filed: May 30, 1978

[51] Int. Cl.[3] ..... A63B 57/00

[52] U.S. Cl. ..... 273/201; 124/50; 221/301

[58] Field of Search ..... 273/201, 33, 26 D, 30, 273/112; 124/45, 48, 49, 50, 51 R, 82, 84, 85, 46, 1; 221/289, 301; 222/240

[56] References Cited

U.S. PATENT DOCUMENTS

| | | | |
|---|---|---|---|
| 1,948,020 | 2/1934 | Buckingham | 273/201 |
| 2,071,356 | 2/1937 | Pagett | 273/201 |
| 2,123,195 | 7/1938 | Middleton | 273/201 |
| 2,171,299 | 8/1939 | Beckett | 273/201 |
| 2,216,853 | 10/1940 | Middleton | 273/201 |
| 2,285,342 | 6/1942 | MacLellan | 221/301 X |
| 2,675,237 | 4/1954 | Willcox | 273/201 |
| 2,931,131 | 4/1960 | Morse | 273/112 |
| 3,003,770 | 10/1961 | Jones | 273/201 |
| 3,599,983 | 8/1971 | Melton | 273/201 |
| 3,756,606 | 9/1973 | Land | 273/201 |
| 3,758,118 | 9/1973 | Willcox | 273/201 |
| 3,785,358 | 1/1978 | D'Angelo et al. | 124/48 X |
| 4,185,608 | 1/1981 | Young et al. | 124/49 |

FOREIGN PATENT DOCUMENTS

| | | | |
|---|---|---|---|
| 67697 | 10/1975 | Australia | 273/201 |
| 1110564 | 4/1968 | United Kingdom | 273/201 |

*Primary Examiner*—Richard C. Pinkham
*Assistant Examiner*—T. Brown
*Attorney, Agent, or Firm*—Whittemore, Hulbert & Belknap

[57] ABSTRACT

The golf ball teeing device comprises a base upon which is mounted a golf ball storage and feeding structure. This structure includes a vertical helical ramp for receiving golf balls which roll theredown in single file. A pivotable feeder arm structure is provided on the base for releasing golf balls one at a time. Contained within the base are means for actuating the feeder arm structure up and down for feeding golf balls one at a time to a golfer to enable the golfer to practice his golf swing. An electrical switch is connected to the actuating means by a cord. It is located remotely from the storage and feeding structure. Actuation of the switch causes the teeing device to go through a cycle and release one golf ball.

17 Claims, 13 Drawing Figures

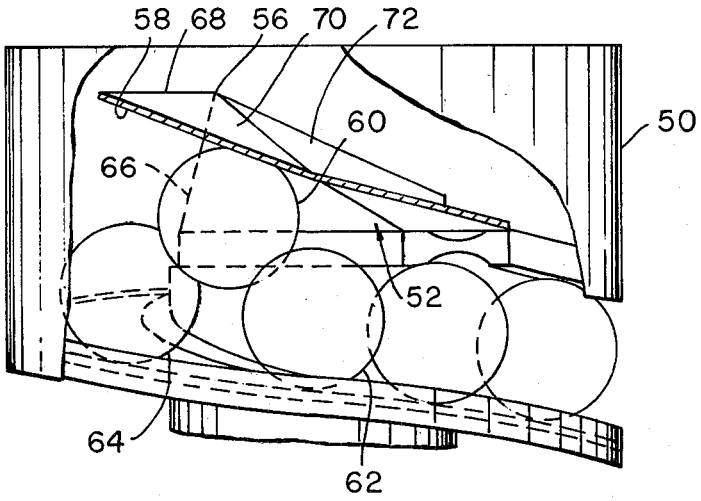
FIG.3
FIG.5
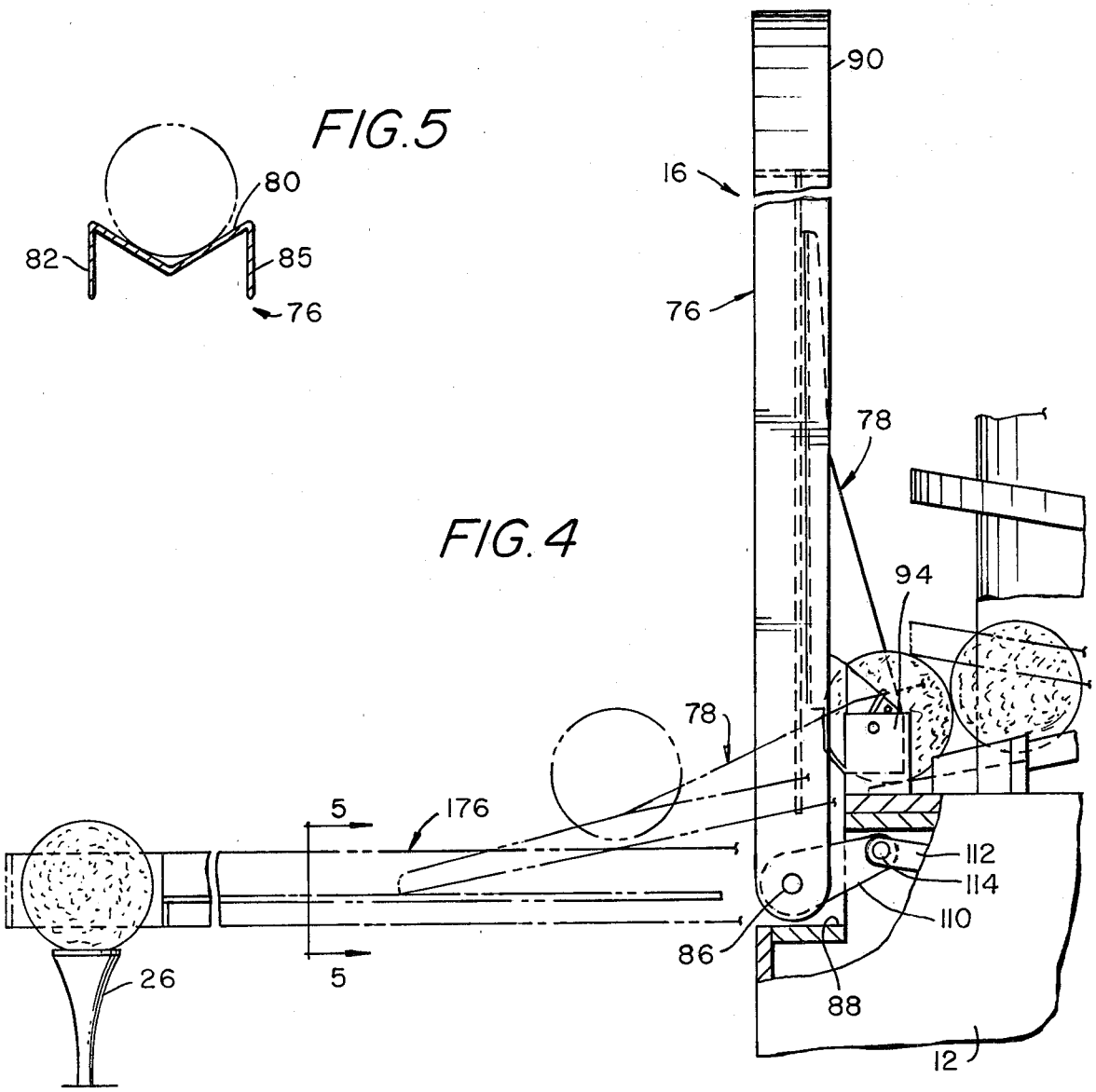
FIG.4

FIG.6
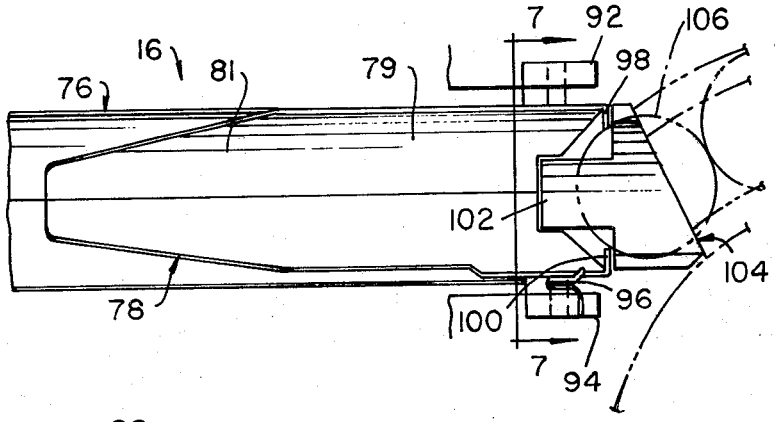
FIG.8
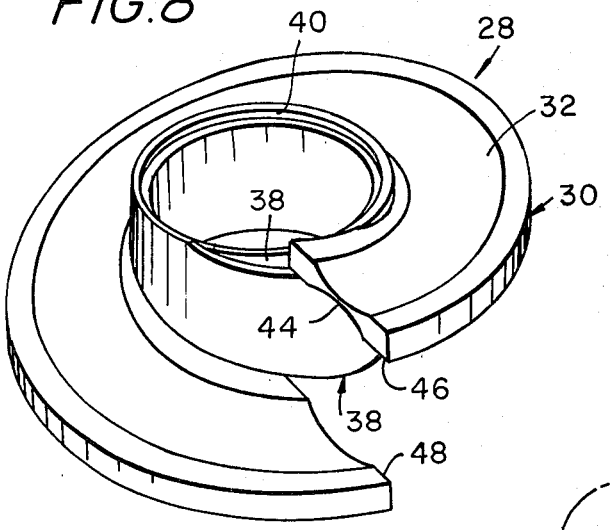
FIG.7
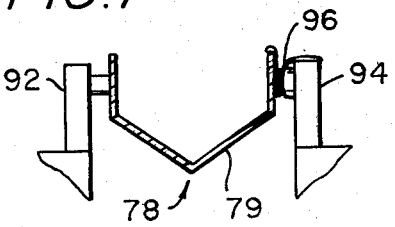
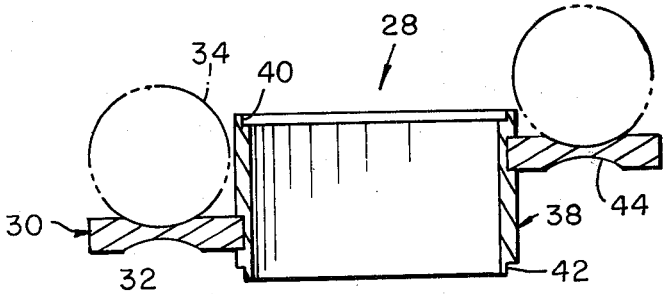
FIG.9
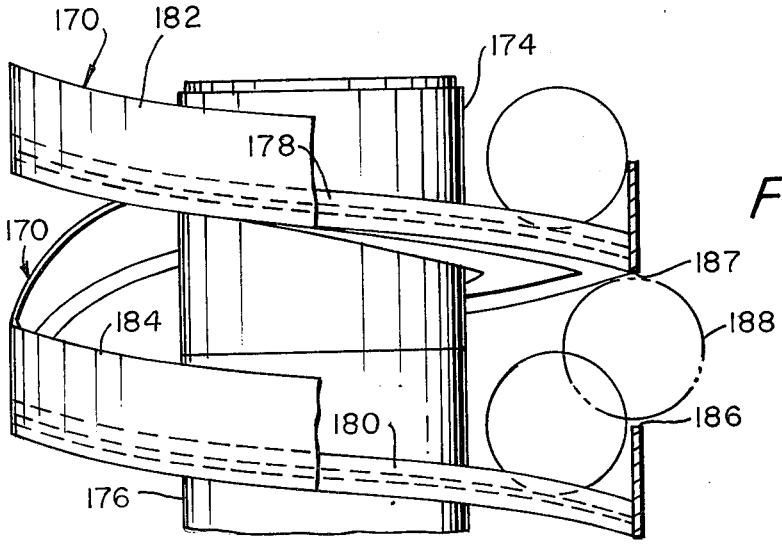
FIG.10

GOLF BALL STORAGE AND FEEDER DEVICE

BACKGROUND OF THE INVENTION

As is well known, the best way to improve one's golf game is to practice swinging with various clubs. Conventionally, golfers have engaged in such practice at golf-driving ranges wherein regular golf balls may be hit. Alternately, golfers have practiced in their own yards or other available space with balls which will not travel very far after being hit.

One of the problems encountered with using either of the above methods for practice is that the golfer must break his stance after hitting a ball in order to tee up a new ball. If the golfer is able to maintain his stance, it is possible for him to make minor corrections in his stance which may lead to more successful hitting of the next ball. However, because he must break his stance and bend over to put a new ball in position to be hit, when he resumes his stance he does not have the same orientation as previously and it is difficult to make minor corrections.

Various types of golf ball teeing devices have been proposed in the past. The purpose of such devices is to permit loading of a large number of golf balls into the device for release, one at a time, by the golfer.

The present invention provides such a golf ball teeing device having numerous features each of which tends to make the structure practical and utilitarian as well as inexpensive to manufacture and durable in use.

SUMMARY OF THE INVENTION

The golf ball teeing device comprises a base upon which is mounted a golf ball storage and feeding structure. This structure includes a vertical helical ramp having a plurality of runs for receiving golf balls which are to roll theredown in single file. A golf ball loading section is provided on the upper end of the ramp. Passageway structure is provided between the ramp and the loading section. The passageway structure includes means for causing balls to enter onto the ramp in single file and to prevent jamming of balls entering the ramp. An exit is provided at the lower end of the ramp. Ball control means are provided at the exit to cause one ball at a time to be released. The ball control means includes actuating structure selectively actuable by a golfer to cause release of a ball when desired.

IN THE DRAWINGS

FIG. 3 is an elevational view of a portion of the golf ball storage and feeding structure viewed in the direction of the arrow 3 of FIG. 2 with portions broken away for the purpose of clarity;

FIG. 4 is an elevational view of the feeder arm structure which forms part of the golf ball storage and feeding structure;

FIG. 5 is a sectional view taken substantially along the line 5—5 of FIG. 4 looking in the direction of the arrows;

FIG. 6 is a plan view of a portion of the feeder arm structure;

FIG. 7 is a sectional view taken substantially along the line 7—7 of FIG. 6 looking in the direction of the arrows;

FIG. 8 is a view in perspective of a section of the ramp structure forming part of the golf ball storage and feeding structure;

FIG. 9 is a sectional view taken through the ramp structure of FIG. 8 looking in the direction of the arrows;

FIG. 10 is an elevational view of another embodiment of the golf ball storage and feeding structure with portions broken away for the purpose of clarity;

Figure 1:
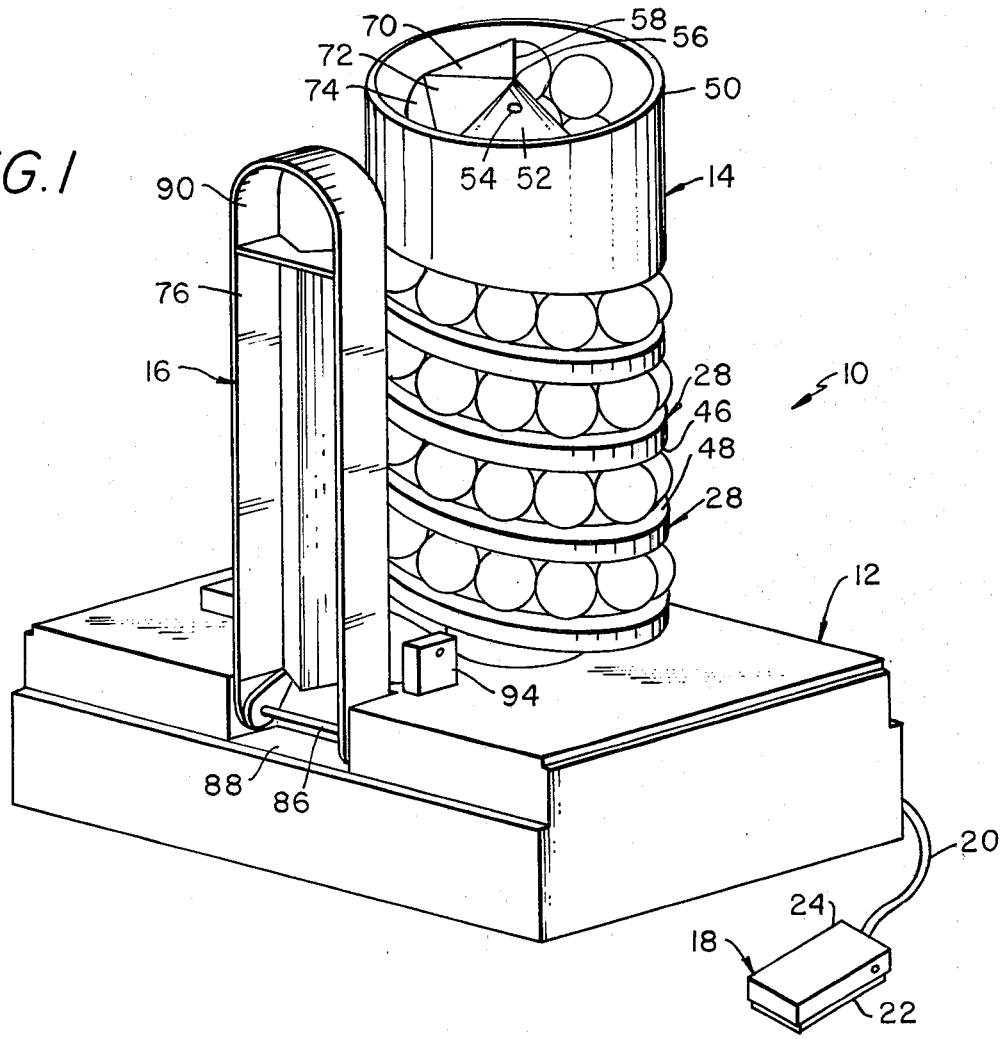
FIG. 1 is a view in perspective of one embodiment of the golf ball teeing device in accordance with the present invention.

Referring to FIG. 1, it will be noted that the golf ball teeing device 10 comprises a base 12 upon which is mounted a golf ball storage and feeding structure 14. A pivotable feeder arm structure 16 forms part of the structure 14. Contained within the base 12 are means for actuating the feeder arm structure 16 up and down for feeding golf balls one at a time to a golfer to enable the golfer to practice his golf swing. An electrical switch 18 is connected to the actuating means within base 12 by means of cord 20. The switch 18 comprises a base 22 upon which is mounted a pivotable top section 24. The section 24 is spring actuated to an upper position. Pressure on section 24, as with the head of a golf club, will cause the feeder arm structure 16 to lower and deposit a golf ball for the golfer.

The golf ball may be deposited upon a tee, such as the conventional tee 26 illustrated in FIG. 4. Alternately, the tee may be comprised of a rubber tube affixed in place so that it will not be knocked away after each ball is hit. The balls may also be deposited directly on the ground or on a mat. Regular golf balls may be used in connection with the teeing device 10. The device 10 also will accommodate use of various kinds of practice balls such as the hollow plastic balls with openings in the surface thereof or balls made of a spongy type material so that they will not travel very far after being hit.

The golf ball storage and feeding structure 14 includes a vertical helical ramp comprised of several sections 28 (FIGS. 8 and 9). The ramp is for receiving golf balls which roll theredown in single file. Each of these sections 28 comprise a section of ramp 30, illustratively shown as being a 360° section. The ramp section may be more or less than 360°. Each 360° section of ramp is referred to as a run. The upper surface 32 of the ramp section is curved to the configuration of a golf ball. Thus, if a golf ball, such as the ball 34, is chipped, has a flat, split or is out of round, it will still roll down the ramp because the damaged portion will not touch the ramp, being elevated therefrom by the remaining undamaged portions of the golf ball which ride on the curved surface 32. This configuration minimizes the chance of a ball stopping on the ramp.

Each ramp section 30 is received on a cylindrical section 38. A helical groove 36 is provided in the upper outer surface of the cylindrical section 38 to receive the ramp section 30 in snap-in fashion. Alternately, the ramp section and cylindrical section may be made as an integral unit.

A peripheral groove 40 is provided on the interior of the upper end of cylindrical section 38 and a similar groove 42 is provided on the exterior of the lower end of the section 38. The sections 38 are snapped together with the grooves interfitting to form the entire helical ramp illustrated in FIG. 1.

The lower surface 44 of each of the ramp sections 30 is also curved. The distance between the two curved surfaces is adequate to permit the balls to roll freely. However, the distance between outer edge portions 46, 48 is less than the diameter of a golf ball. This prevents the balls from escaping as a consequence of centrifugal force as they roll down the ramp.

Figure 2:
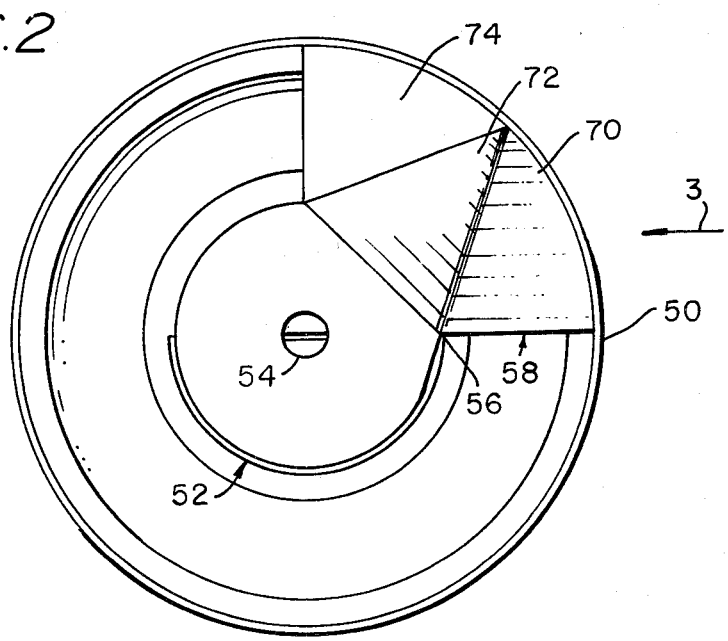
FIG. 2 is a top plan view of the golf ball storage and feeding structure.
Figure 11:
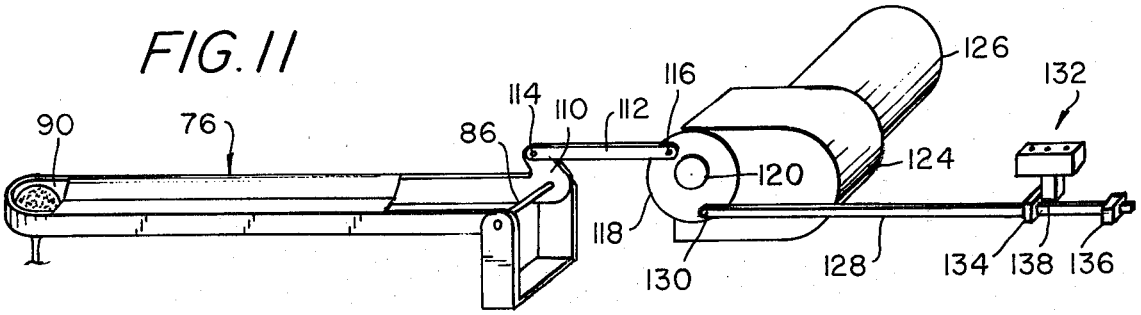
FIG. 11 is diagrammatic view of the structure for actuating the feeder arm structure with the arm in the down position.

A cylindrical metallic member 50 is secured to the upper end of the ramp structure. The function of this member is to control loading of golf balls into the teeing device. As will be noted in FIGS. 1, 2, and 3, a cone structure 52 is secured centrally of the member 50 by means of a screw 54. The apex 56 of the cone structure is offset from the center of the base of the cone with the result that all exteriorly exposed surface portions of the cone tend to direct the balls onto the upper portion of the ramp and in a direction toward opening 58 which feeds balls to main portion of the helical ramp. The opening 58 is rectangular with a side-to-side dimension being such as to permit a single ball to roll freely therethrough. The vertical dimension of opening 58 is less than the diameter of two standard golf balls.

In the embodiment shown it has been found that the optimum dimension for the height of the opening 58 is 3.2 inches. A standard golf ball has a diameter of 1.6875 inches. Thus, the opening is 0.175 inches less than the diameter of two golf balls. The reason for this is to prevent two golf balls from entering through openings 58 simultaneously. One golf ball may rest on top of another golf ball as a consequence of loading a plurality of golf balls into the teeing device from a bucket of balls. As shown in FIG. 3, ball 60 is above balls 62, 64. As the balls entered through opening 58, the upper ball 60, is a consequence of the opening 58 being slightly smaller than the diameter of two balls, was held up, permitting ball 62 to move down the ramp. Ball 64 was held up by ball 60, making a space 61 which, after ball 62 travels further, will be large enough for ball 60 to fall into. If it were not for this feature, the balls could enter through the opening at the same time and jam.

The opening 58 is defined by straight side 66 of cone structure 52, edge 68 of baffle section 70, the inner surface of the cylindrical member 50 and upper surface of the ramp section. The baffle section 70 is angled downwardly toward the ramp section. Thus, as the balls proceed down the ramp, the baffle section 70 tends to cause any ball resting on top of other balls, such as the ball 60, to be forced in between two balls which are already on the ramp. Eventually, the ball 60 is forced between balls 62, 64 and will roll freely down the ramp. Seldom will any balls get stuck at this point.

The baffle section 70 is one of the three baffle sections 70, 72, 74. As previously mentioned, baffle section 70 helps define the entranceway onto the ramp. Baffle section 72, which extends from baffle section 70, at a sharper angle than section 70, also defines part of the entranceway onto the ramp. Baffle section 74 extends from baffle section 72 directly onto the uppermost run of the ramp. This baffle section also forms part of the entranceway onto the main ramp. The configuration of the baffle sections, including the different angles at which they are oriented, aids in breading up balls when they are emptied into the upper portion of the teeing device. These baffle sections are at a somewhat steeper angle than the angle of the ramp and thus tend to give balls momentum and force when the balls roll onto the ramp. This helps to break up the balls and prevents them from jamming.

As will be noted in FIGS. 1 and 3, all of the balls are visible either from the side of the device or by looking into the top of the device. Additionally, all of the balls are accessible by hand so that any jamming which does occur can be easily detected and corrected.

The means for feeding a ball to a position whereby the golfer may hit it will now be described. This means includes the feeder arm structure 16. The feeder arm structure 16 comprises two arm elements 76, 78. Arm element 76 is a long arm having a V-shaped ball rolling surface 80 with downwardly depending side edge portions 82, 84 (FIG. 5). The inner end of arm element 76 is pivotally mounted to the base 12 by means of a shaft 86. A notch 88 is provided in the base to receive the inner end of arm element 76. A U-shaped loop 90 is provided on the outer end of the arm element 76 for a ball to fall through. This element directs the ball to the proper downward position beneath arm element 76 so as, for example, to come to rest on the tee 26. In the downward position illustrated in dotted lines in FIG. 4, the arm element 76 is slightly downwardly inclined from its inner end to its outer end so that a ball will roll thereon as desired.

The second arm element 78 is of shorter length. This arm element is pivotally mounted on the top of the base 12 by means of mounting blocks 92, 94. Arm element 78 is actuated to its raised position by means of arm element 76 which is power driven. Arm element 78 is moved to the lowered position by means of the weight of a ball. A small spring 96 (FIG. 6) is provided at the pivotal mounting of arm element 78 to inhibit free movement of the arm.

The arm element 78 serves two purposes. Firstly, when it is in its lowered position as shown in FIG. 4, it is at a steeper angle than the arm element 76 to insure that the balls will roll theredown freely. The ball subsequently rolls onto arm element 76 and its rate of rolling is diminished so that it will not be rolling quickly when it comes to the end of arm element 76. This permits the ball to more readily settle onto the tee 26 or other device where it is desired to deposit the ball. As will be noted in FIG. 7, arm element 78 has a trough-like configuration 79 adjacent to the exit from the ramp. This trough-like configuration captures a ball and prevents it from initially escaping. The outer end portion 81 is trapped and does not have upstanding side walls.

The second function of arm element 78 is to feed balls one at a time from the ball ramp upon each descent of arm element 76. As will be noted in FIG. 6, arm element 78 has inwardly directed ears 98, 100 at the inner end thereof. There is a notch in the inner end of the arm element 78 which is received over projecting portion 102 of exit ramp element 104 which is a separate element secured adjacent to the lower end of the ball ramp. The distance between the ears 98, 100 is less than the diameter of a ball. Thus, when arm element 78 is in its lowered position, as illustrated in FIG. 4, the next ball 106 cannot roll theredown from the ball ramp. However, when the arm element 78 is in the raised position, the ears 98, 100 are pivoted to a position beneath the upper surface of exit ramp portion 102. Thus the next ball 106 will roll into abutment with the inner end of arm element 78 at a point above the ears 98, 100. When the arm element 76 is actuated to its downward position, the pressure of ball 106 against arm element 78 will cause arm element 78 to pivot downwardly, ultimately to the position shown in FIG. 4 when the ball rolls theredown. Upon such pivoting, the ears 98, 100 pivot upwardly to the reverse or inner side of the ball 106 thus permitting this ball to roll downwardly but preventing the next ball from so doing. In this fashion, balls are delivered one at a time for the golfer to hit.

The means for actuating the arm element 76 will now be described. These means are best shown in FIGS. 4, 11, 12 and 13. As will be noted in FIG. 4, a crank member 110 is provided on the inner end of the arm element 76. A second crank member 112 is pivotally connected at 114 to crank member 110. Crank member 112 extends interiorly of the base 12. As will be noted in FIGS. 11 and 12, the other end of crank member 112 is pivotally connected at 116 to outer hub element 118. When element 118 is driven in the counterclockwise direction as viewed in FIG. 11, it will cause crank member 112 to move forwardly thus pivoting the arm element 76 to the downward position. When the hub element 118 is driven in the clockwise direction as viewed in FIG. 12, it will cause the crank member 112 to retract and result in raising the arm element 76. The outer hub element 118 is mounted on an inner hub element 120, which is a torque limiting hub functioning as a slip clutch. With this arrangement, the arm element 76 may be raised or lowered manually without damaging the driving mechanism. The inner hub element 120 is driven by the output of gear box 124. The gear box 124 in turn is driven by an electric motor 126.

An elongated rod 128 is also pivotally mounted at one end 130 to the outer hub element 118. The rod 128 is associated with a limit switch structure 132. As will be noted, a pair of spaced apart block elements 134, 136 are mounted adjacent the outer end of the rod 128. Switch element 138 of switch 132 is positioned between the blocks 134, 136. When the arm element 76 has been lowered to the lowermost position block 134 is actuated with element 138 to cause the electric motor 126 to be de-energized. Similarly, when the arm element 76 has been raised, switch element 138 is actuated by block 136 to again de-energize the electric motor 126. The switch 132 is a single pole, double throw limit switch.

Figure 12:
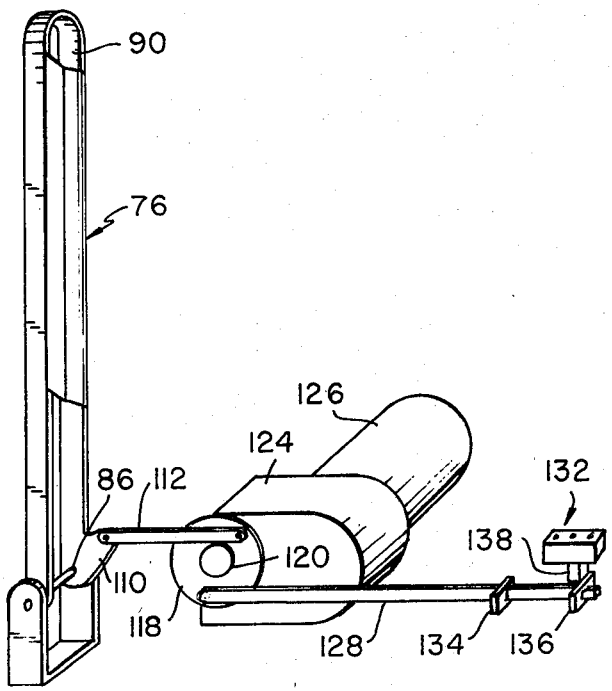
FIG. 12 is a diagrammatic view as in FIG. 11 with the arm in the up position.
Figure 13:
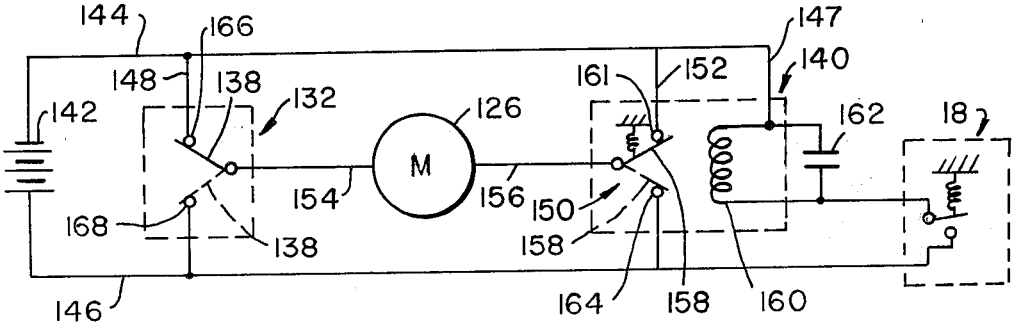
FIG. 13 is a schematic view of the electrical system utilized to actuate the feeder arm structure.

FIG. 12 illustrates the electrical circuitry involved in actuating the motor 126. A dc battery 142 is provided as a source of power. Leads 144, 146 extend from the terminals of the battery 142. The switch 132 is connected across leads 144, 146 by lead 148. A relay 140 including switch 150 is also connected across leads 144, 146 by lead 152. The motor 126 has leads 154, 156 extending from the terminals thereof. One lead 154 is connected to switch element 138 of switch 132. The lead 156 is connected to switch element 158 of switch 150. The relay coil 160 and capacitor 162 are connected in parallel with each other and in series with switch 18 across the leads 144, 146 by lead 147.

When the system is at rest, with the switch 18 being open, switch elements 138, 158 assume the position illustrated in solid lines. In this position, no power is provided to the motor 126.

When the coil 160 is energized, it will cause switch element 158 to close against contact 164. This energization of coil 160 will occur when the switch 18 is closed, as by the golfer depressing it with the head of his golf club. The golfer releases switch 18 after actuation and this switch returns to its open position. The capacitor 162 will be energized with the same polarity as the coil 160 at this time. With the switch element 158 engaging contact 164 and the switch element 138 engaging contact 166, power of one polarity is provided to the motor 126. Illustratively, this will cause the motor 126 to run in a counterclockwise direction as viewed in FIG. 12 thus lowering the arm element 76 whereupon a ball will be deposited.

Upon the golfer releasing the switch 18, this switch will automatically open. The connection of the coil 160 to power will thus be opened thereby de-energizing the coil 160. However, the capacitor 162, having been charged during this process, will continue to suply current to the coil 160 for a brief period of time. There is sufficient capacity to cause the motor to continue to run until the arm element 76 is completely in its down position.

When the arm element 76 is in the lowered position, limit switch 132 is actuated to cause switch element 138 to engage contact 168. Power is thus disconnected from the motor 126.

As previously mentioned, the motor 126 is a permanent magnet reversible motor. When such a motor is disconnected from power, it is short circuited. This short circuiting of the permanent magnet field motor produces an electrodynamic breaking effect thus brings the motor to a relatively smooth stop which allows the arm element 76 to come to a relatively smooth stop at the tee.

The capacitor 162 has sufficient charge to maintain the coil 160 energized for a short time after the arm element 76 has been lowered. Thus the switch element 158 will remain in the position shown in dotted lines for a short time thus giving a small pause to allow the ball to settle onto the tee.

After the charge on capacitor 162 has been depleated, coil 160 is de-energized and switch element 158 returns to the solid line position on contact 161. In this position, the motor 126 is again connected to power but with the opposite polarity. The motor will now run in the reverse direction, illustratively clockwise. The motor will thus cause retraction of the arm element 76. When arm element 76 reaches the upper or retracted position, limit switch 132 will again be actuated to cause switch element 138 to return to the solid line position. This results in de-energizing motor 126, with the arm element 76 coming to a relatively smooth stop as previously described. The system is now ready for another cycle to deliver another ball when desired.

FIG. 10 illustrates another embodiment of the ramp structure. As will be noted in FIG. 10, ramp segments 170, 172 have central cylindrical portions 174, 176 as previously described which are secured together also as previously described. The distance between adjacent ramp portions 178, 180 is greater than the diameter of a golf ball. However, a retaining wall structure 182, 184 is provided around the outer periphery of each ramp portion 178, 180. Thus, when a ball rolls down the ramp, it will be prevented from rolling off the ramp by the retaining wall structure and the lower edge 187 of the next ramp portion is greater than the diameter of a golf ball. Consequently, a ball, such as the ball 188, may be manually removed from the ramp when desired. Such removal may be necessary if a ball is so out of shape or damaged to such an extent that it will not roll properly down the ramp.

What I claim as my invention:

1. A golf ball storage and feeder device comprising a vertical helical ramp for receiving golf balls which are to roll theredown in single file, a golf ball loading structure on the upper end of the ramp, passageway structure between the ramp and the loading structure, said golf ball loading structure including means to receive a plurality of golf balls and a plurality of baffle surfaces slanted at different angles downwardly toward said passageway structure to cause golf balls to roll toward said passageway structure and to prevent golf balls from jamming together while so rolling, an exit at the lower end of the ramp, and ball control means at said exit to cause one ball at a time to be released, said ball control means including actuating structure selectively actuable by a golfer to cause release of a ball when desired.

2. Structure as set forth in claim 1, wherein said passageway structure includes means for causing balls to enter onto the ramp in single file and to prevent jamming of the balls entering the ramp.

3. A golf ball storage and feeder device comprising a base, a vertical helical ramp on the base having a plurality of runs for receiving golf balls which are to roll theredown in single file, a golf ball loading structure on the upper end of the ramp, passageway structure between the ramp and the loading structure, said passageway structure including means for causing balls to enter onto the ramp in single file and to prevent jamming of the balls entering the ramp, said gold ball loading structure including an open topped cylindrical member on top of said ramp to receive a plurality of golf balls which may be dumped thereon from a container all at once, a plurality of baffle surfaces within said cylindrical member slanted at different angles downwardly toward said passageway structure to cause golf balls to roll toward said passageway structure and to prevent golf balls from jamming together while so rolling, a cone structure between said baffle surfaces and said passageway structure, said cone structure having an offset apex located adjacent to the opening of said passageway structure, the cone structure having a flat surface extending downwardly from said apex and forming part of said passageway structure, an exit at the lower end of the ramp, and ball control means at said exit to cause one ball at a time to be released, said ball control means including actuating structure selectively actuable by a golfer to cause release of a ball when desired.

4. A golf ball storage and feeder device comprising a base, a vertical helical ramp on the base having a plurality of runs for receiving golf balls which are to roll theredown in single file, said ramp being characterized in that the uppermost surface of the ramp has a central curbed depression extending for the length of the ramp, said curved depression having a configuration mating with the outer surface of a golf ball, said ramp being further characterized in the provision of a curved depression provided centrally of the lowermost surface of the ramp and extending for the length of the ramp, the runs of the ramp being spaced apart a distance to permit golf balls to roll freely through said curved surfaces but with the remaining portions of the runs being too close together to permit balls to move laterally off the ramp, a golf ball loading structure on the upper end of the ramp, passageway structure between the ramp and the loading structure, said passageway structure including means for causing balls to enter onto the ramp in single file and to prevent jamming of balls entering the ramp, an exit at the lower end of the ramp, and ball control means at said exit to cause one ball at a time to be released, said ball control means including actuating structure selectively actuable by a golfer to cause release of a ball when desired.

5. A golf ball storage and feeder device comprising a base, a vertical helical ramp on the base having a plurality of runs for receiving golf balls which are to roll theredown in single file, a golf ball loading structure on the upper end of the ramp, passageway structure between the ramp and the loading structure, said passageway structure including means for causing balls to enter onto the ramp in single file and to prevent jamming of balls entering the ramp, an exit at the lower end of the ramp, and ball control means at said exit to cause one ball at a time to be released including a pivotal feeder arm structure on said base adjacent said exit of the ramp, means to pivot said feeder arm structure up and down to release a golf ball, said feeder arm structure in the down position being angled downwardly and having a surface thereon for balls to roll away from the ramp structure, said ball control means including actuating structure selectively actuable by a golfer to cause release of a ball when desired, said feeder arm structure including a first elongated arm raised and lowered by said actuating structure adapted to receive a second shorter arm nested therein, a second shorter arm secured to the exit of said ramp above said first arm and adapted to nest in said first arm, said second arm including means to block exit of golf balls from the ramp structure when the arm structure is in the lowered position and to release a golf ball when the arm structure is in the raised position.

6. A golf ball storage and feeder device comprising a base, a vertical helical ramp on the base having a plurality of runs for receiving golf balls which are to roll theredown in single file positioned on the base, a golf ball loading structure on the upper end of the ramp, passageway structure between the ramp and the loading structure, said passageway structure including means for causing balls to enter onto the ramp in single file and to prevent jamming of balls entering the ramp, an exit on the lower end of the ramp, and ball control means at said exit to cause one ball at a time to be released, said ball control means including a pivotal feeder arm structure on said base adjacent said exit of the ramp and electrical actuating means for pivoting said feeder arm structure up and down to cause release of a golf ball when desired, said feeder arm structure, in the down position being angled downward and having a surface thereon for balls to roll away from the ramp structure, said electrical actuating means including a manually depressible switch remotely located with respect to the rest of the golf ball storage and feeder arm device which is selectively actuable by a golfer, said switch being operable on actuation to cause said electrical actuating means to lower said feeder arm structure and release a ball, said electrical actuating means also including a reversible electric motor, a source of electric power connected thereto, limit switch means connected between said electric motor and source of electric power, said limit switch means being actuated by said feeder arm structure to temporarily disconnect power to said electric motor when the feeder arm structure is in the lowered position and to discontinue power to said electric motor when said feeder arm structure is returned to the raised position.

7. A golf ball storage and feeder device comprising a vertical helical ramp for receiving golf balls which are to roll theredown in single file, a golf ball loading structure on the upper end of the ramp, passageway structure between the ramp and the loading structure, said golf ball loading structure including means to receive a plurality of golf balls, and a cone structure having an offset apex located adjacent to the opening to said passageway structure having a flat surface extending downwardly from said apex and forming part of said passageway structure, an exit at the lower end of the ramp, and ball control means at said exit to cause one ball at a time to be released, said ball control means including actuating structure selectively actuable by a golfer to cause release of a ball when desired.

8. A golf ball storage and feeder device comprising a vertical helical ramp for receiving golf balls which are to roll theredown in single file, said ramp being characterized in that the uppermost surface of the ramp has a central curved depression extending for the length of the ramp, said curved depression having a configuration mating with the outer surface of a golf ball, said ramp being further characterized in the provision of a curved depression provided centrally of the lowermost surface of the ramp and extending for the length of the ramp, a golf ball loading structure on the upper end of the ramp, passageway structure between the ramp and the loading structure, an exit at the lower end of the ramp, and ball control means at said exit to cause one ball at a time to be released, said ball control means including actuating structure selectively actuable by a golfer to cause release of a ball when desired.

9. Structure as set forth in claim 8, wherein the ramp includes a plurality of runs and the runs of the ramp are spaced apart a distance to permit golf balls to roll freely through said curved surfaces but with the remaining portions of the runs being too close together to permit balls to move laterally off the ramp.

10. A golf ball storage and feeder device comprising a vertical helical ramp for receiving golf balls which are to roll theredown in single file, a golf ball loading structure on the upper end of the ramp, passageway structure between the ramp and the loading structure, an exit at the lower end of the ramp, and ball control means at said exit to cause one ball at a time to be released including a pivotal feeder arm structure on said base adjacent said exit of the ramp, and means to pivot said feeder arm structure up and down to release a golf ball, said ball control means including actuating structure selectively actuable by a golfer to cause release of a ball when desired, said feeder arm structure including a first elongated arm raised and lowered by said actuating structure adapted to receive a second shorter arm nested therein, a second shorter arm secured to the exit of said ramp above said first arm and adapted to nest in said first arm.

11. Structure as set forth in claim 10, wherein said second arm further includes means to block exit of golf balls from the ramp structure when the arm structure is in the lowered position and to release a golf ball when the arm structure is in the raised position.

12. A golf ball storage and feeder device comprising a vertical helical ramp for receiving golf balls which are to roll theredown in single file, a golf ball loading structure on the upper end of the ramp, passageway structure between the ramp and the loading structure, an exit on the lower end of the ramp, and ball control means at said exit to cause one ball at a time to be released, said ball control means including a pivotal feeder arm structure on said base adjacent said exit of the ramp and electrical actuating means for pivoting said feeder arm structure up and down to cause release of a golf ball when desired, said electrical actuating means including a reversible electric motor, a source of electric power connected thereto, limit switch means connected between said electric motor and source of electric power, said limit switch means being actuated by said feeder arm structure to temporarily disconnect power to said electric motor when the feeder arm structure is in the lowered position and to discontinue power to said electric motor when said feeder arm structure is returned to the raised position.

13. Structure as set forth in claim 12, wherein said electrical actuating means further includes a manually depressible switch remotely located with respect to the rest of the golf ball storage and feeder arm device which is selectively actuable by a golfer, said switch being operable on actuation to cause said electrical actuating means to lower said feeder arm structure and release a ball.

14. A golf ball storage and feeder device comprising a vertical helical ramp for receiving golf balls which are to roll theredown in single file, a golf ball loading structure on the upper end of the ramp, passageway structure between the ramp and the loading structure, said golf ball loading structure including means to receive a plurality of golf balls and a plurality of baffle surfaces slanted at different angles downwardly toward said passageway structure and a cone structure between said baffle surfaces and said passageway structure, said baffle surfaces and cone structure being operable to cause golf balls to roll toward said passageway structure and to prevent golf balls from jamming together while so rolling, an exit at the lower end of the ramp, and ball control means at said exit to cause one ball at a time to be released, said ball control means including actuating structure selectively actuable by a golfer to cause release of a ball when desired.

15. Structure as set forth in claim 14, wherein said cone structure has an offset apex located adjacent to the opening to said passageway structure.

16. Structure as set forth in claim 15, wherein the cone structure has a flat surface extending downwardly from said apex and forming part of said passageway structure.

17. A golf ball storage and feeder device comprising a base, a vertical helical ramp having a plurality of runs for receiving golf balls which are to roll theredown in single file positioned on the base, a golf ball loading structure on the upper end of the ramp, passageway structure between the ramp and the loading structure including an opening, said opening having a horizontal dimension sufficient to allow the ball to pass therethrough, said opening having a vertical dimension slightly less than the diameter of two standard golf balls to prevent overlying golf balls from entering the passageway simultaneously with the balls thereunder, and upper wall structure in said passageway structure extending from top of said opening downwardly toward said ramp, said base loading structure and passageway structure including cooperating means for causing balls to enter onto the ramp in single file and to prevent jamming of balls entering the ramp, and exiting at the lower end of the ramp, and ball control means at said exit to cause one ball at a time to be released, said ball control means including actuating structure selectively actuable by a golfer to cause release of a ball when desired.

* * * * *